US006431365B1

(12) United States Patent
Money

(10) Patent No.: US 6,431,365 B1
(45) Date of Patent: Aug. 13, 2002

(54) CONTAINERS FOR FOODSTUFF

(75) Inventor: Julian David Kryle Money, Richmond (GB)

(73) Assignee: Rapid Action Packaging Limited, London (GB)

( * ) Notice: Subject to any disclaimer, the term of this patent is extended or adjusted under 35 U.S.C. 154(b) by 0 days.

(21) Appl. No.: 09/554,782

(22) PCT Filed: Nov. 18, 1998

(86) PCT No.: PCT/GB98/03467

§ 371 (c)(1),
(2), (4) Date: Jun. 14, 2000

(87) PCT Pub. No.: WO99/25618

PCT Pub. Date: May 27, 1999

(30) Foreign Application Priority Data

Nov. 18, 1997 (GB) ..... 9724380

(51) Int. Cl.[7] ..... B65D 25/54
(52) U.S. Cl. ..... 206/776; 229/115
(58) Field of Search ..... 206/775–777, 206/551, 784; 229/115; 426/106, 112, 115, 119, 128

(56) References Cited

U.S. PATENT DOCUMENTS 1,664,111 A * 3/1928 Johnson ..... 229/115
1,758,585 A * 5/1930 Riegel ..... 229/115
1,933,643 A 11/1933 Tanner
2,107,946 A 2/1938 Inman
2,220,110 A 11/1940 Layton
2,349,589 A * 5/1944 Harrington ..... 229/115
2,701,090 A * 2/1955 Buttery ..... 229/115
3,006,527 A * 10/1961 Lofquist, Jr. ..... 229/115
3,118,533 A 1/1964 Curtis
4,253,601 A * 3/1981 Kossoff ..... 229/115
5,325,960 A * 7/1994 Sims ..... 229/115
5,375,713 A * 12/1994 Horvat et al. ..... 229/115

OTHER PUBLICATIONS

International Search Report; PCT/GB98/03467; M. Vantomme; Feb. 10, 1999.

* cited by examiner

*Primary Examiner*—Luan K. Bui
(74) *Attorney, Agent, or Firm*—Fish & Richardson P.C.

(57) ABSTRACT

A container for foodstuff is formed from a blank of card and having triangular end walls connected by rectangular side walls to form a triangular prism shaped container. One side wall of the container is hinged to another wall of the container to provide an opening for insertion/removal of foodstuff and to form a lid for closing the opening. The edges of the lid and edges of the container extending from the hinge have integral tabs with a fold line at the hinge, whereby the tabs fold inwardly beneath the lid as it is closed over the opening to assist in retaining foodstuff in the container.

19 Claims, 10 Drawing Sheets

CONTAINERS FOR FOODSTUFF

This invention relates to containers for foodstuff and is particularly, although not exclusively, applicable to items such as sandwiches, rolls, confectionery or the like.

U.S. Pat. No. 1,933,643 discloses a container for foodstuff formed from a blank of card and having triangular end walls connected by rectangular side walls to form a triangular prism shaped container. One side wall of the container is hinged to another of the walls to provide an opening for insertion/removal of foodstuff.

This invention provides a container for foodstuff formed from a blank of card and having triangular end walls connected by rectangular side walls to form a triangular prism shaped container, one side wall of the container being hinged to another wall of the container to provide an opening for insertion/removal of foodstuff and to form a lid for closing the opening, the edges of the lid and the edges of the container extending from the hinge having integral tabs with a fold line at the hinge whereby the tabs fold inwardly beneath the lid as it is closed over the opening to assist in retaining foodstuff in the container.

Preferably, "mitred" fold lines are formed between the adjacent tabs to facilitate inward over the opening to the container as the lid is folded closed.

The side wall forming the lid may be hinged to one of said triangular walls or to another side wall.

In a specific arrangement according to the invention, the side walls may be of isosceles triangular form with a 90° apex angle and the hinge lid is provided at the base of one of the triangular end walls.

In the latter case the hinge lid may be hinged to the base of one of the triangular end walls of the container.

In any of the above arrangements the triangular end walls may have fold lines extending from the apex of the prism to the opposite edges of the walls to permit the blank to be folded flat about the apex.

In the case where the triangular end walls are isosceles triangles, the fold lines extending from the apex of the prism may be perpendicular bisectors of the opposing bases of the triangular end walls.

In the case where the side wall forming the lid of the container is hinged to the base of one of the triangular end walls, the fold line extending through the triangular end wall may continue through the lid so that the lid folds flat with the container.

In any of the above arrangements the blank for the container may be a one-piece blank and may have joints between the side walls of the container at the apex of the container and in one of the triangular end walls.

Also in any of the above arrangements the lid may have an elongate rectangular aperture in which a transparent film is mounted to enable the contents of the container to be viewed.

The lid may also have a flap formed on its opposite edge to its hinge connection to one end wall of the container to be folded over and attached to the other end wall of the container to hold the container closed.

The following is a description of a specific embodiment of the invention, reference being made to the accompanying drawings in which.

Figure 1:
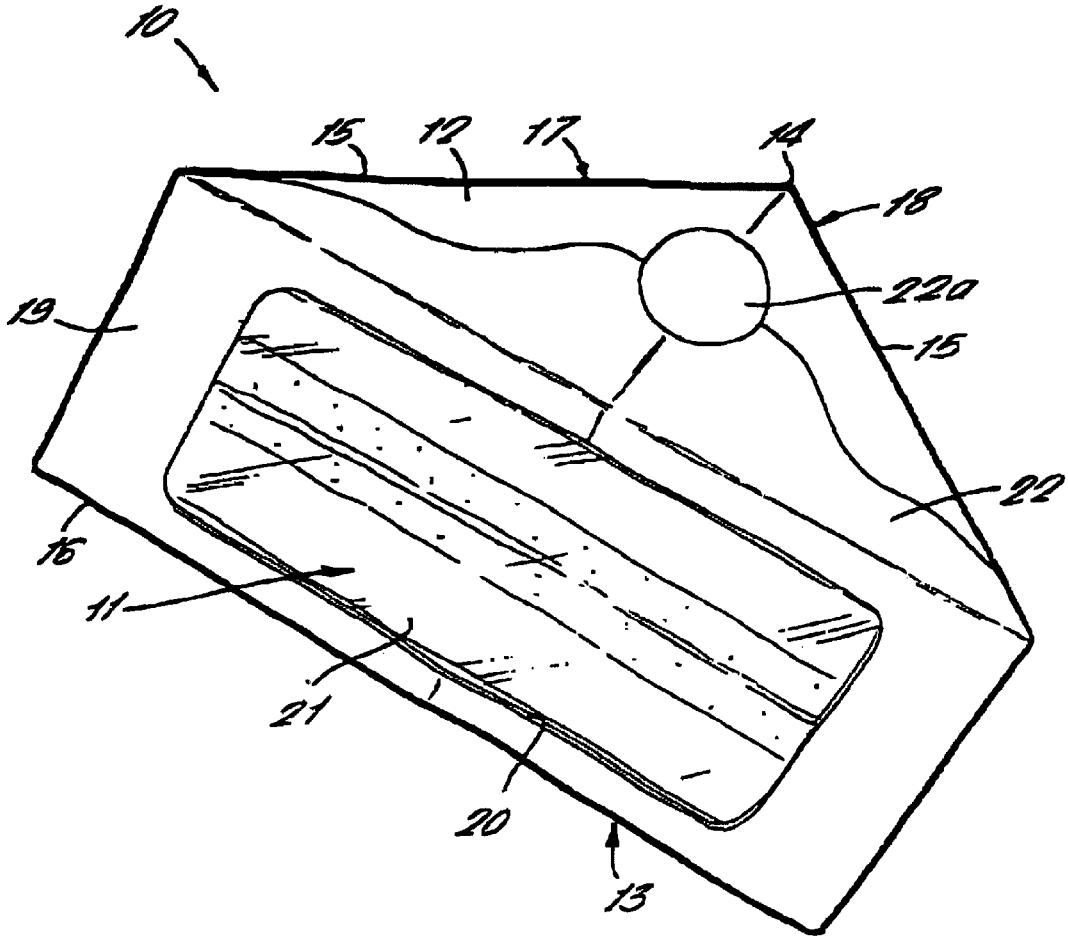
FIG. 1 is a perspective view of a triangular prism shaped container for sandwiches formed from a one-piece blank of card.

Referring firstly to FIG. 1 of the drawings, there is shown a triangular prism shaped cardboard container indicated generally at 10 for holding a diagonally cut round of sandwiches indicated generally at 11. The container has two isosceles triangle shaped end walls 12,13 having right angled apexes 14, equal side edges 15 and base edges 16. The end walls 12 are spaced apart by rectangular side walls 18, extending along the side edges 15 of the triangle and a bottom wall 19 extending along the base edges 16 of the bottom wall. The bottom wall is formed with an elongate rectangular window 20 in which transparent film 21 is mounted to enable the contents of the container to be viewed.

The bottom wall 19 of the container is hinged along one of the base edges 16 of the container by a preformed crease to permit opening of the container and has a shaped flap 22 along its opposite edge which overlies the lower part of the triangular end wall. The flap carries an adhesive label 22*a* to adhere to the end wall 12 and hold the lid closed. Alternatively, the flap 22 may be formed with a catch or may be arranged to tuck into a slat in the end wall 12 to hold the lid 19 closed.

Figure 2:
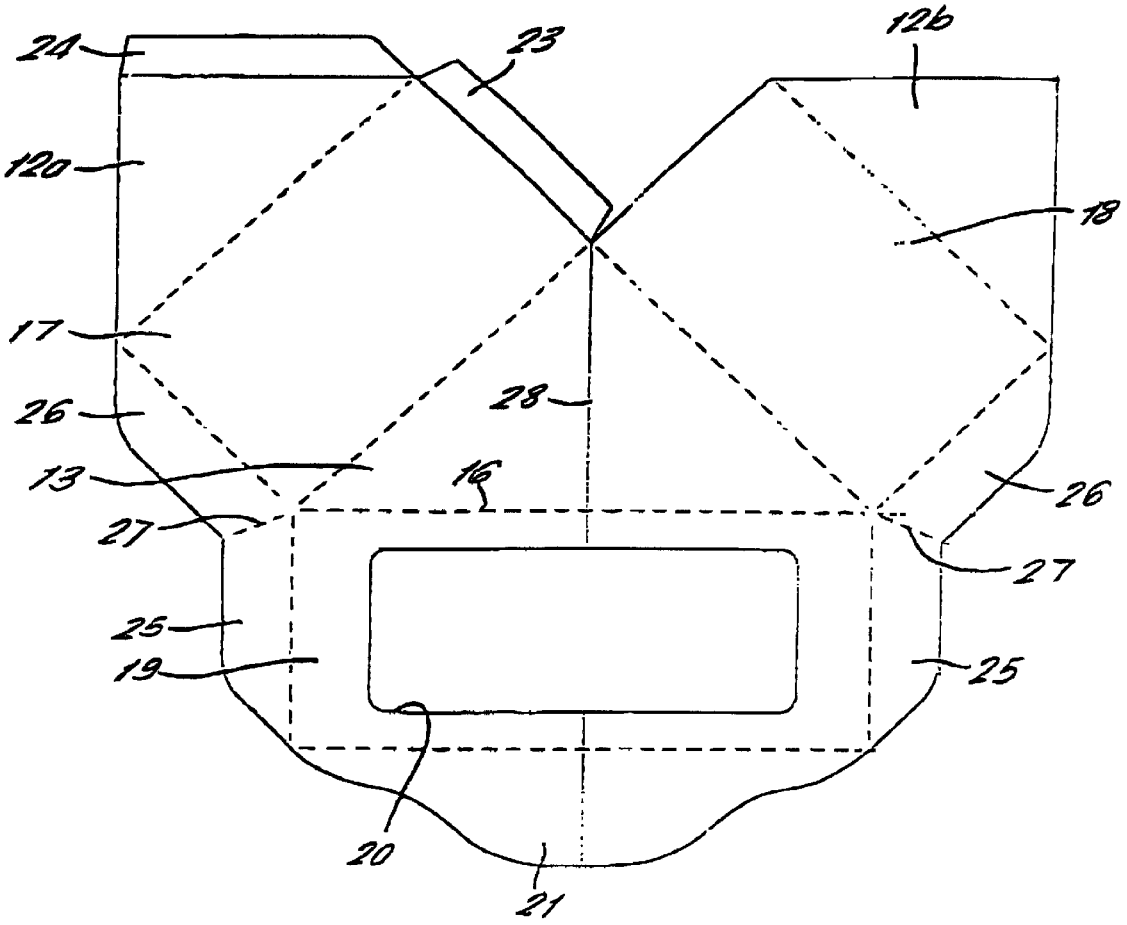
FIG. 2 illustrates a cut and folded/creased blank of card from which a triangular prism formed container, as shown in FIG. 1, is formed.

FIG. 2 of the drawings illustrates the one-piece blank of card from which the container 10 is formed. The dotted or broken lines indicate preformed fold lines. The end of the side wall 17 adjacent side wall 18 is formed with an end flap 23 which is adhered to the end of side wall 18 to form the apex of the prism shaped container. One of the triangular shaped end walls is formed in the blank in two parts 12*a*, 12*b* on the side walls 17 and 18. Part 12*a* is formed with a flap or tab 24 along one edge of the triangular side wall for gluing to the corresponding edge of the other triangular side wall part 12*b* to form the complete triangular side wall.

The ends of the lid 19 have flaps 25 hinged thereto which are formed integrally with similar flaps 26 on the adjacent ends of the side walls 17 and 18. Fold lines are formed between the respective flaps 25 and 26 as indicated at 27.

Figure 3:
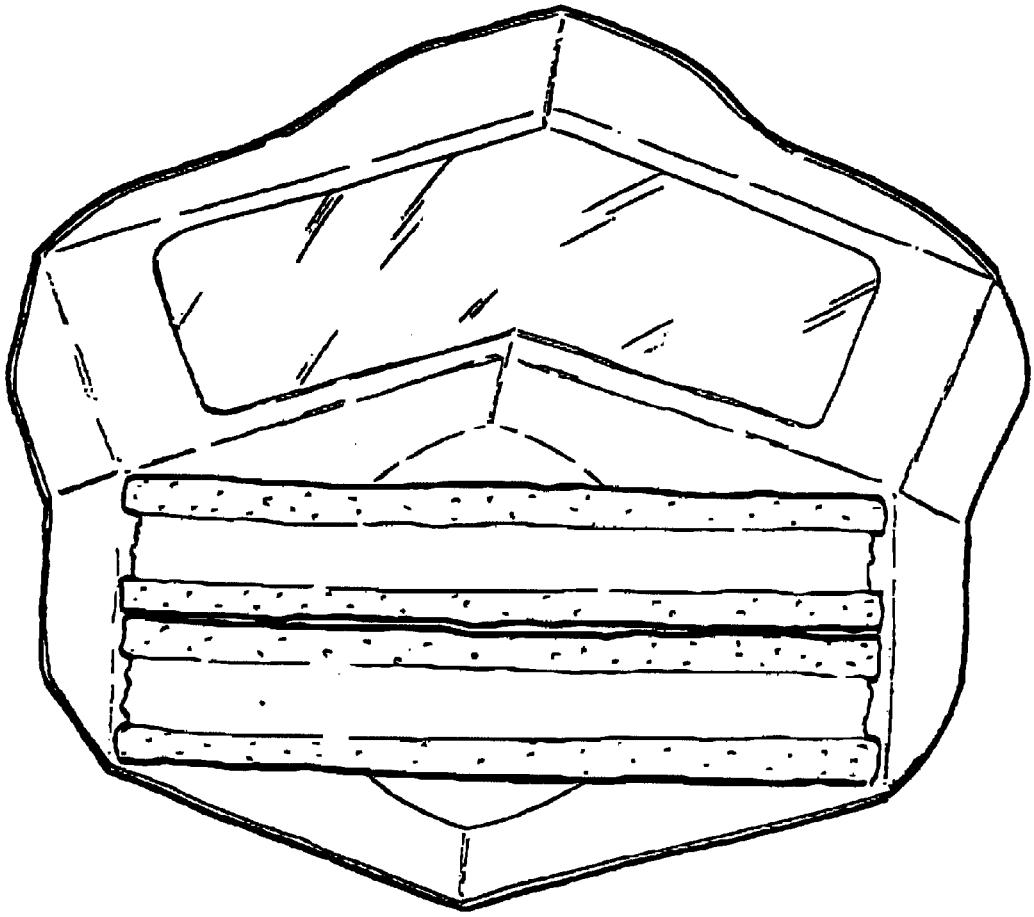
FIG. 3 shows the container of FIG. 1 opened for insertion/removal of sandwiches.
Figure 4:
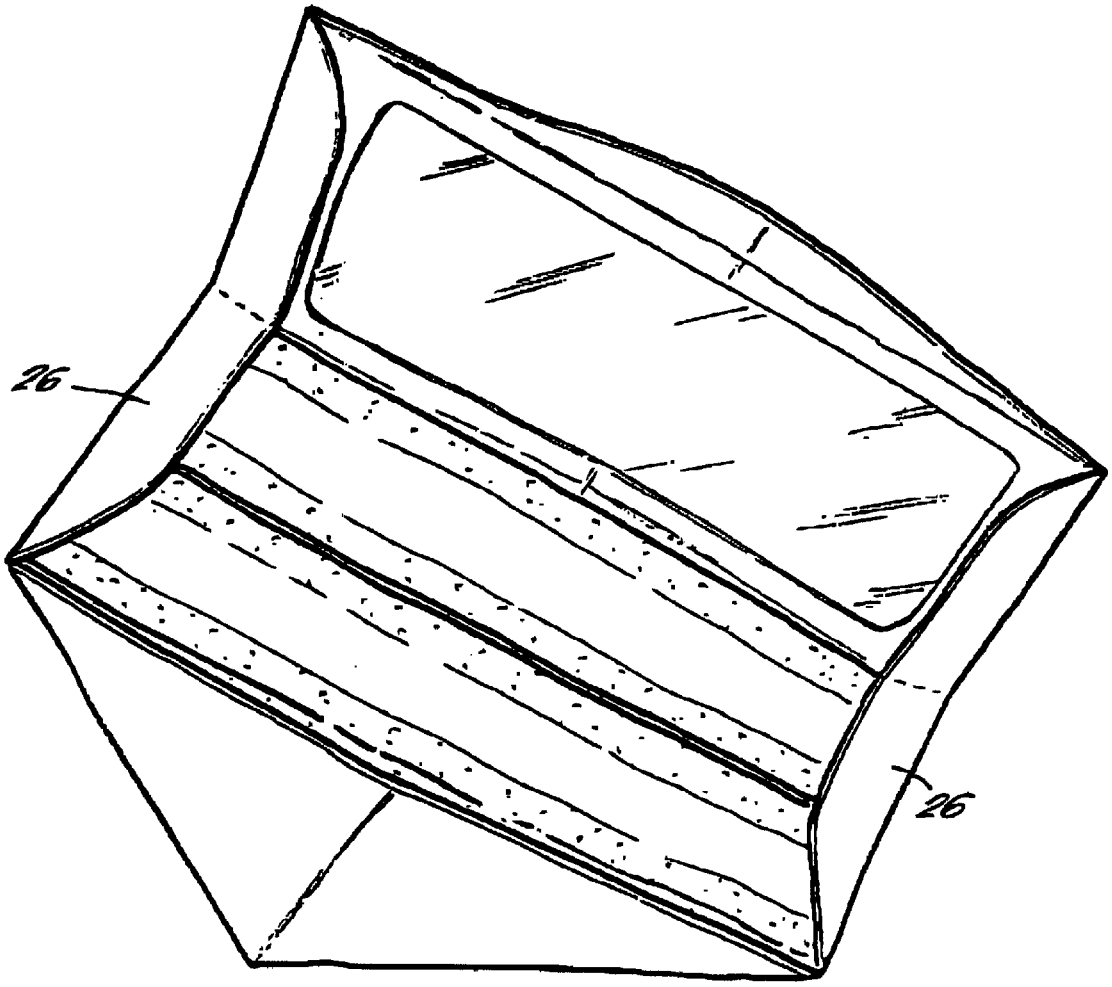
FIG. 4 is a view of the container of FIG. 1 with sandwiches inserted immediately before closure of the container lid.

FIG. 3 illustrates the. loading of a round of cut sandwiches in the container and FIG. 4 shows the lid 19 about to be closed after tucking in the flaps 25,26. As will be seen, flaps 26 overlie the ends of the sandwiches in the container and serve to hold the sandwiches in place as the container is closed. Once the flap has been closed over the opening to the container, an adhesive label is applied to the free edge of the flap 22 to adhere the flap to the end wall 12 which it overlies.

Figure 5:
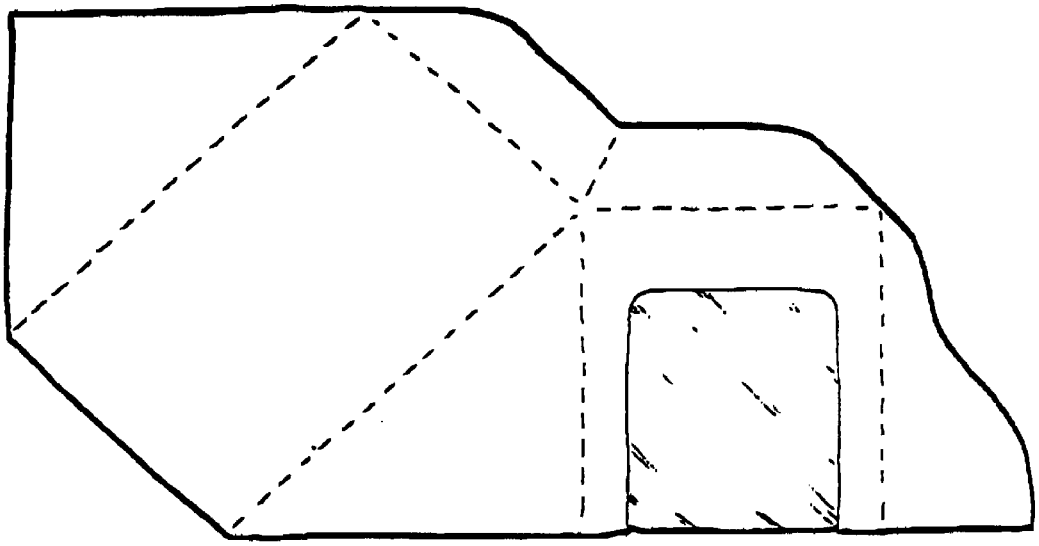
FIG. 5 shows the blank FIG. 1 folded in half for storage prior to use.

Returning to the blank shown in FIG. 2, a fold line 28 is formed as a perpendicular bi-sector from the apex of the one-piece triangle 12 through the base edge 16 of the triangle on through the lid 19 and flap 22. The fold between the flap 23 and side walls 17 and flap 24 and triangle portion 12*a* form a continuation of the fold line 28 through the other side of the container so that the container can be folded flat about the apex 28, as shown in FIG. 5. The fold lines through the triangular end walls of the container allow the end walls to bow outwardly, as shown in FIG. 3, which enables the fingers holding a sandwich to be inserted into the container making it easier to place and remove sandwiches in and from the container respectively., The arrangement thus provides a very simple form of sandwich container which can be stored in flat form, readily erected and folded with sandwiches and is also easy to open for removal of the sandwiches by the customer.

It will be appreciated that many modifications may be made to the above described embodiment without departing from the scope of the invention. For example, the window or a further window may be formed in other walls of the container. Also part of the container, for example, parts of the end and side walls adjacent the apex of the container may be formed in flexible paper.

Figure 6:
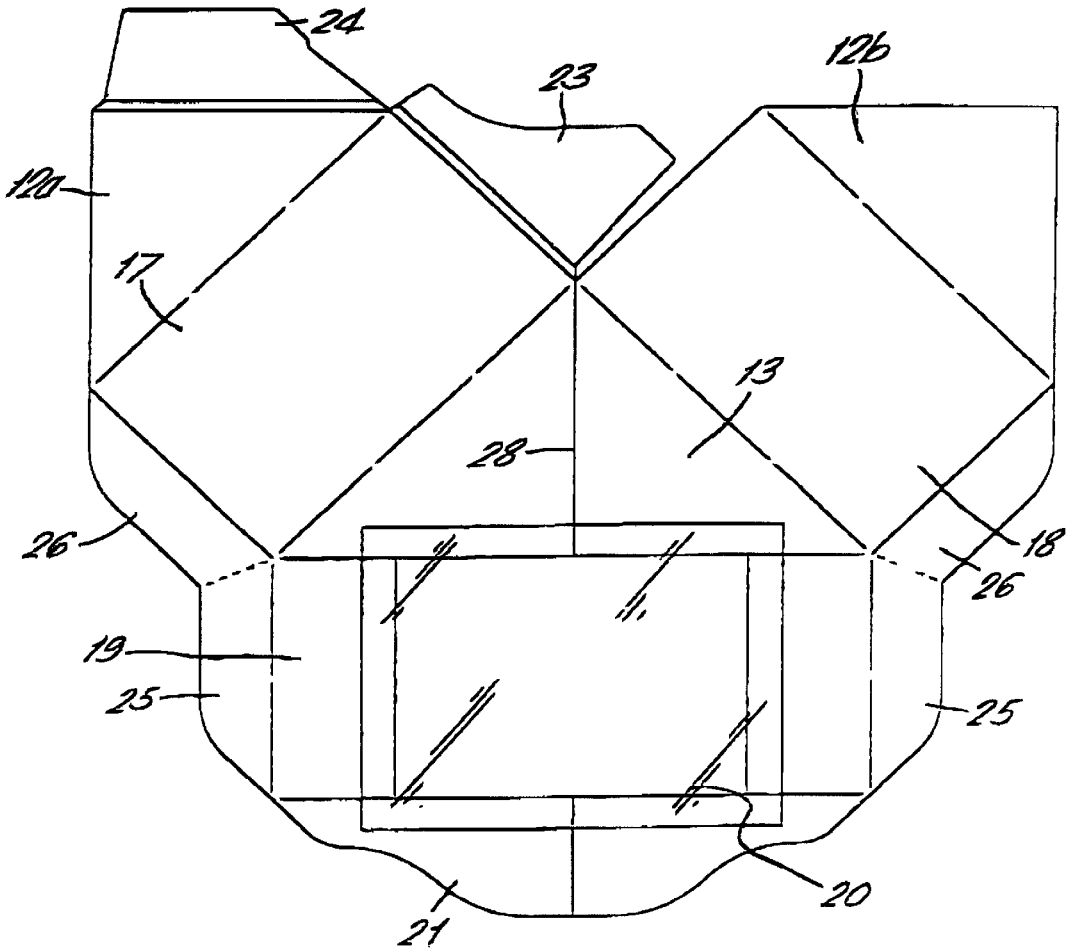
FIG. 6 illustrates a modified blank form of the blank of FIG. 2 for producing a container generally similar to that of FIG. 1.

Referring now to FIG. 6 of the drawings, there is shown a blank similar to that of FIG. 2 for forming a container which is generally similar to that illustrated in FIG. 1. Like parts have been allotted the same reference numerals. The main difference is that the rectangular window 20 in the bottom wall or lid 19 of the container is enlarged to extend across the full width of the container. Also, the tabs 23, 24 are made somewhat larger to be adhered to the side wall 18 and side wall part 12*b* respectively. The blank is otherwise the same as that of FIG. 2 and the container formed is of much the same appearance as that of FIG. 1.

Figure 7:
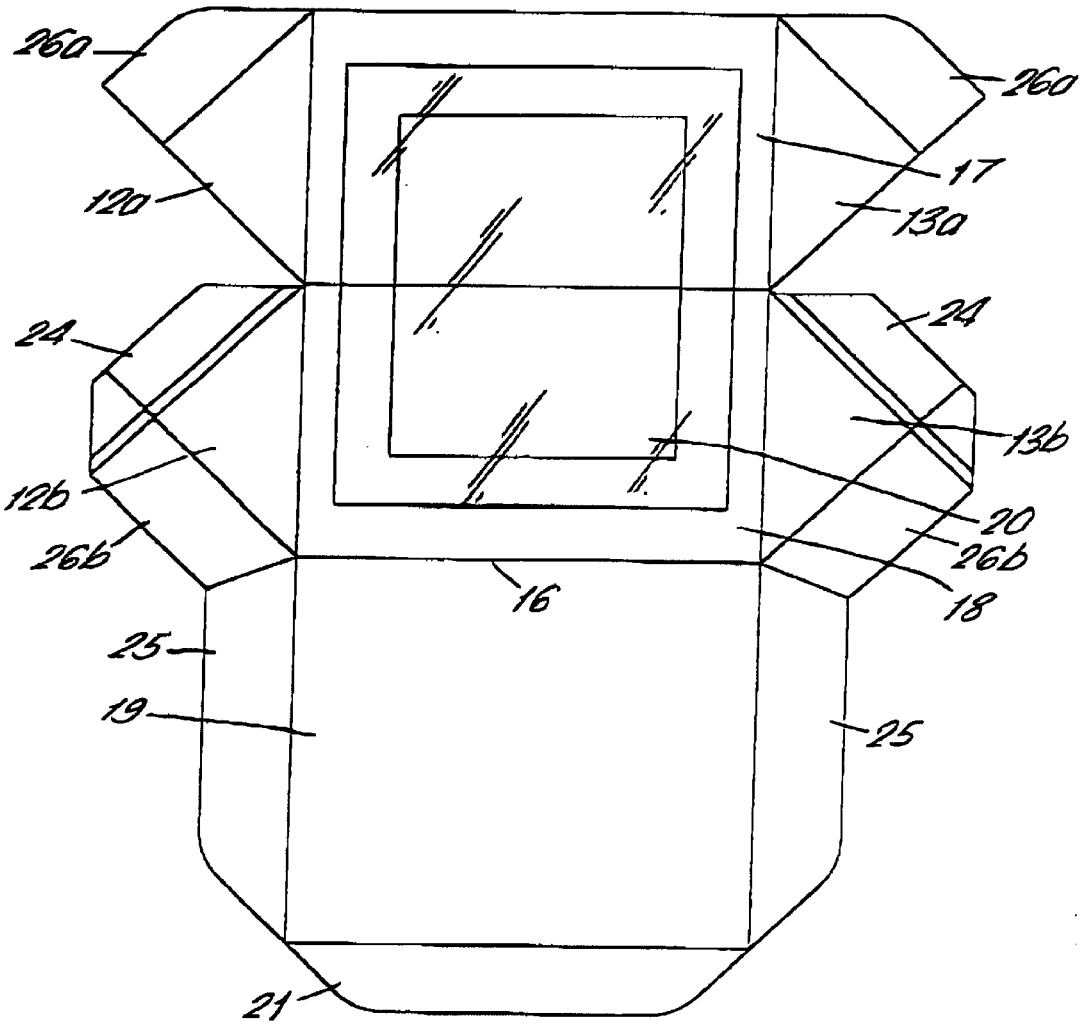
FIG. 7 illustrates a blank for forming a further form of the container.
Figure 8:
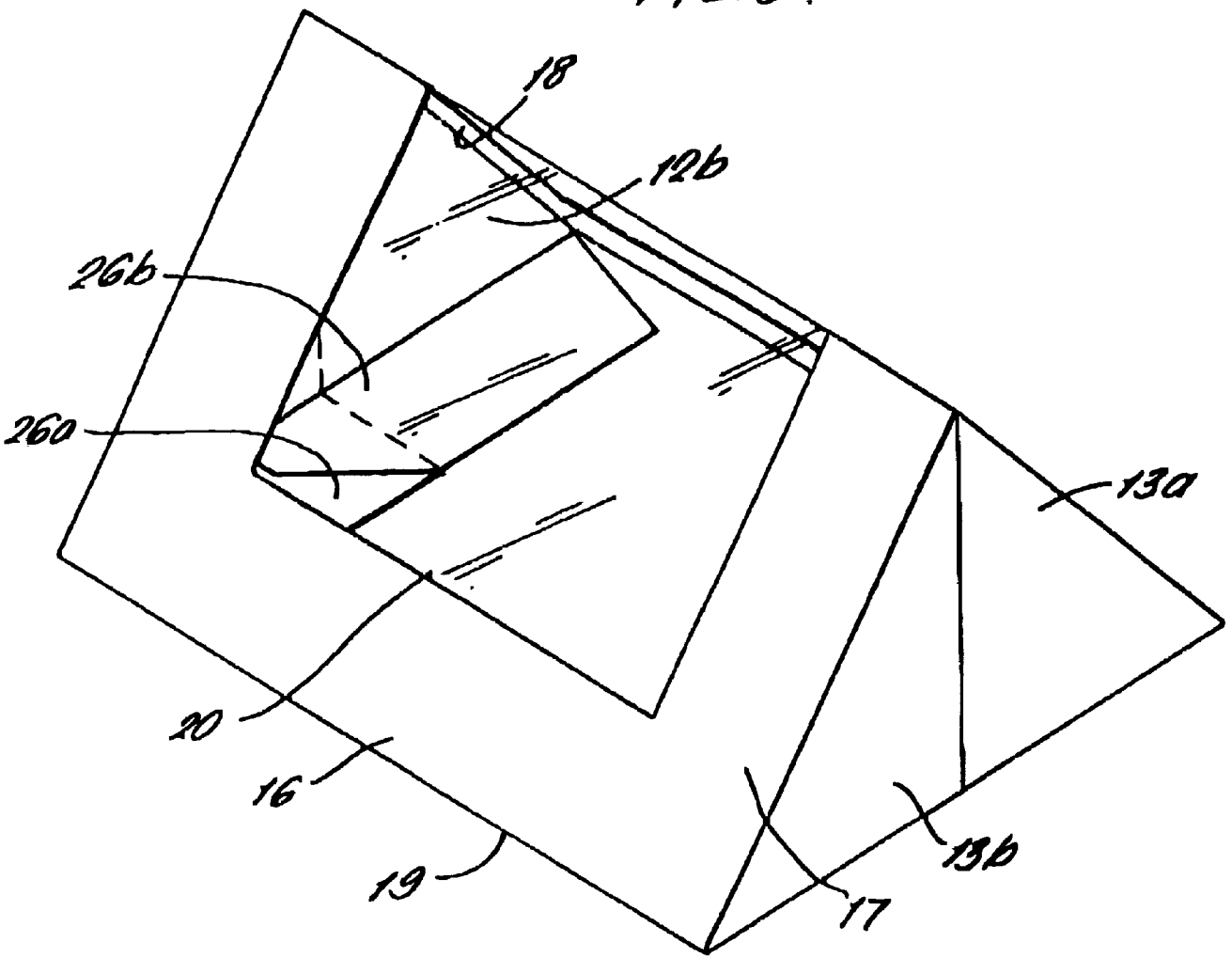
FIG. 8 is a perspective view of a container formed from the blank of FIG. 7.

Reference is now made to FIGS. 7 and 8 which show further modified blank and container formed from the blank. Again, like parts have been allotted the same reference numerals. In this case, the window 20 is formed in two of the side walls 18,19 through the apex between the walls. The lid 19 is hinged to one of the side walls 18 and each triangular end wall 12,13 is formed in two parts 12*a*, 12*b* and 13*a*, 13*b* hinged respectively to the side walls 17 and 18. The end wall parts 12*b* and 13*b* have flaps or tabs 24 to be adhered to the adjacent end wall parts 12*a*, 13*a* to form the complete triangular end walls. The end wall parts 12*a*, 12*b* and 13*a*, 13*b* each have flap portions 26*a* and 26*b* formed thereon which come together when the end wall parts are secured together to form complete flaps along the edges of the end walls 12 and 13 extending from the hinge 16, as described in the enclosed embodiment.

FIG. 8 shows the completed container formed from the blank of FIG. 7 and it will be noted in particular that the window 20 extends through two side walls of the container to enable the contents to be viewed from either side of the container.

Figure 9:
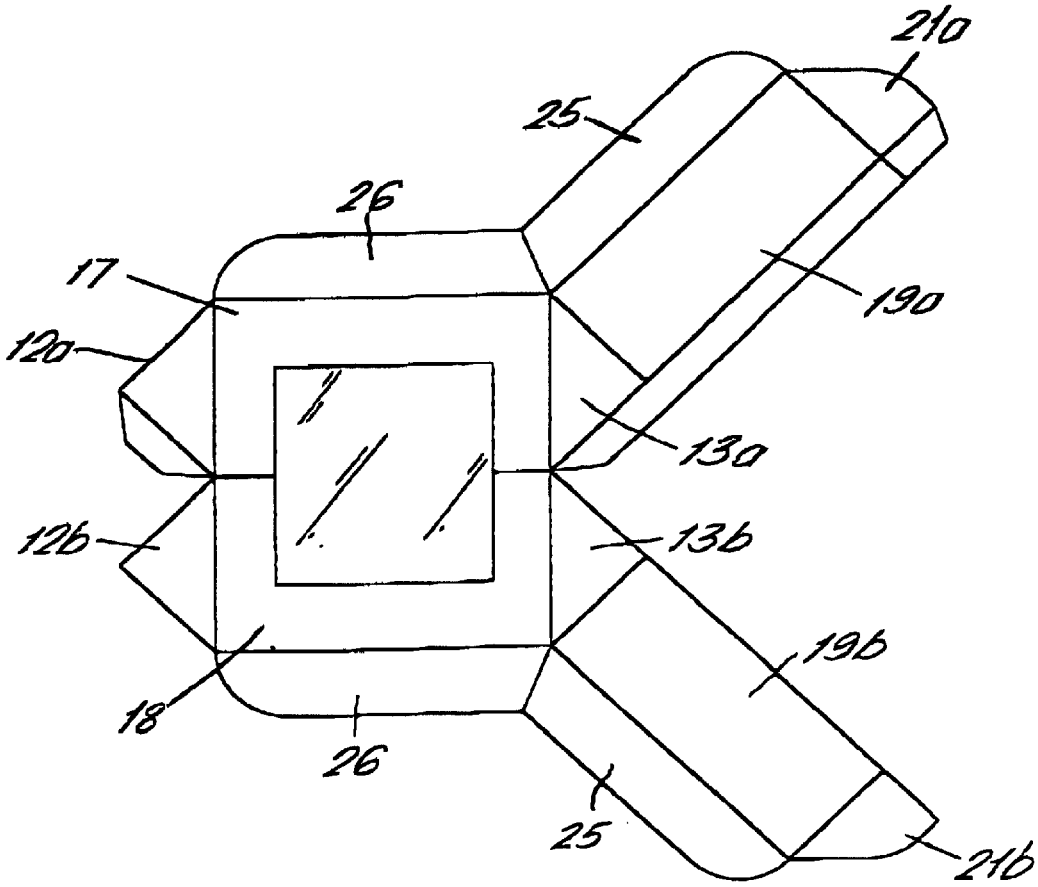
FIG. 9 shows a modified form of the blank of FIG. 7 for forming a container similar to that of FIG. 8.
Figure 10:
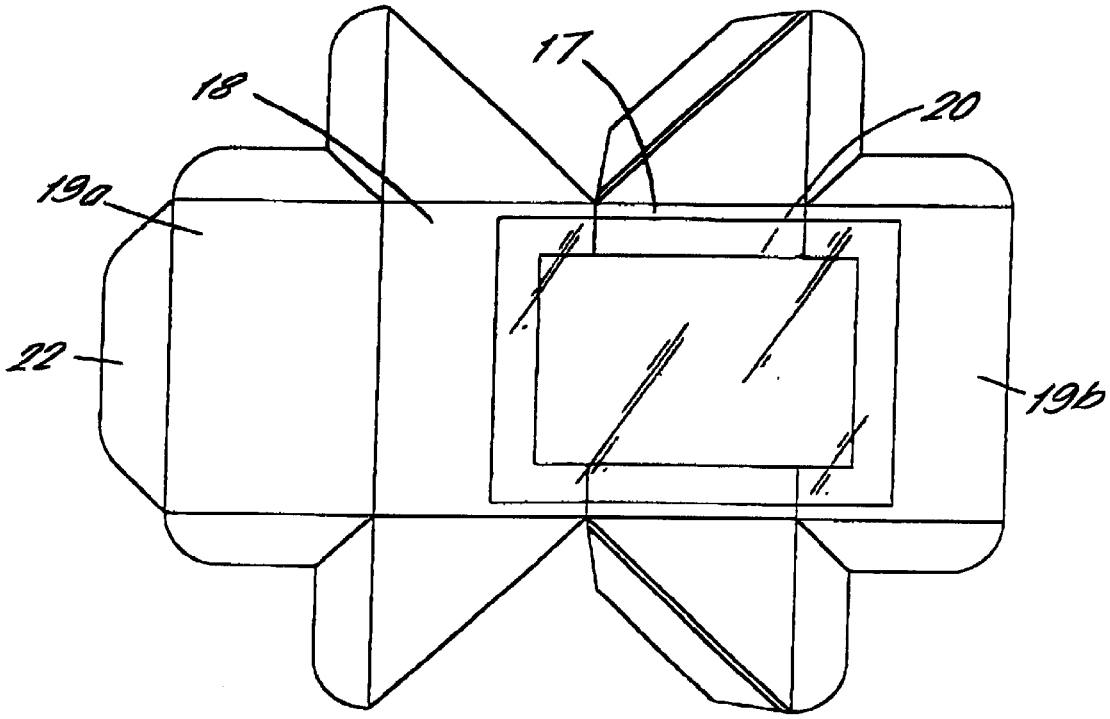
FIG. 10 is a further modification of the blank of FIG. 7 for forming a container similar to that of FIG. 8.

FIG. 9 of the drawing shows an alternative blank arrangement for forming the container of FIG. 7. FIG. 10 shows a further variation of the blank arrangement of FIG. 7 and in this case the lid or bottom or 19 of the container is formed in two parts, 19*a* and 19*b* which fold together to close the container with the flap 22 on part 19*a* attached by an adhesive label or strip to the other part 19*b* of the lid to connect the lid parts together. In this case the window 20 is disposed mainly inside 17 of the container but projects into side 18 at one end of the window and into side 19*b* at the other end.

Both lid parts have tabs extending along the sides thereof from the hinges and the sides of the container along the opening also having tabs extending from the hinges connected by mitred folds to the flaps on the lid parts to fold inwardly over the lid parts when the latter are closed.

What is claimed is:

1. A container for foodstuff formed from a blank of card and having triangular end walls connected by rectangular side walls to form a triangular prism shaped container, one side wall of the container being hinged along the base of one of the end walls to provide an opening for insertion/removal of foodstuff and to form a lid for closing the opening and a window formed in said lid to permit the contents of the container to be viewed; characterized in that the edges of the lid and edges of the container extending from the hinge have integral tabs with a fold line at the hinge whereby the tabs fold inwardly beneath the lid as it is closed over the opening to assist in retaining foodstuff in the container, the integral tabs folding under the lid beyond the periphery of the window in the lid.

2. A container as claimed in claim 1, characterized in that mitered fold lines are formed between adjacent tabs to facilitate inward folding of the tabs over the opening to the container as the lid is folded closed.

3. A container as claimed in claim 1 or claim 2, characterized in that the side wall forming the lid is hinged to one of said triangular shaped end walls.

4. A container as claimed in claim 1 or claim 2, characterized in that the side wall forming the lid is hinged to another side wall.

5. A container as claimed in claim 1 or claim 2, characterized in that the end walls are of isosceles triangular form with a 90° apex angle and the hinged lid is provided by a side wall at the base of the triangular end walls .

6. A container as claimed in claim 1, characterized in that the triangular end walls have fold lines extending from an apex of the prism to the opposite base edges of the walls to permit the blank to be folded flat about the apex.

7. A container as claimed in claim 6, wherein the triangular end walls are isosceles triangles, and characterized in that the fold lines extending from the apex of the prism are perpendicular bisectors of the opposing bases of the triangular end walls.

8. A container as claimed in claim 6 or claim 7, wherein the side wall forming the lid of the container is hinged to the base of one of the triangular end walls and characterized in that the fold line extending through the triangular end wall continues through the lid so that the lid folds flat with the container.

9. A container as claimed in claim 1 or claim 2, characterized in that the blank for the container is a one-piece blank and has joins between the side walls of the container at an apex of the container and in one of the triangular walls.

10. A container as claimed in claim 1 characterized in that at least one side wall has a window to permit the contents of the container to be viewed.

11. A container as claimed in claim 10, characterized in that the window is formed in said lid.

12. A container as claimed in claim 10, characterized in that the window is formed in adjacent parts of two of the side walls other than the lid.

13. A container as claimed in any of claims 10 to 12, characterized in that the window comprises an elongate rectangular aperture in which a transparent film is mounted to enable the contents of the container to be viewed.

14. A container as claimed in claim 1 or claim 2 characterized in that the lid has a flap formed on its edge to the hinge connection to said one wall of the container to be folded over or under another wall of the container when the lid is closed.

15. A container as claimed in claim 1 or claim 2 characterized in that lid is formed in two parts hinged respectively to walls of the container on opposite sides of the opening and means are provided to connect the lid parts together in the closed position thereof, both lid parts and the container edges having tabs which fold inwardly beneath the lid parts in the closed position thereof.

16. A container for foodstuff formed from a blank of card and having triangular end walls connected by rectangular side walls to form a triangular prism shaped container, one side wall of the container being hinged to another wall of the container to provide an opening for insertion/removal of foodstuff and to form a lid for closing the opening; characterized in that the triangular end walls have fold lines extending from an apex of the prism to the opposite base edges of the walls to permit the blank to be folded flat about the apex.

17. A container as claimed in claim 16, wherein the side wall forming the lid of the container is hinged to the base of one of the triangular end walls, and the fold line extending through said one triangular end wall continues through the lid so that the lid folds flat with the container.

18. A container as claimed in claim 16 or claim 17, wherein the end walls are of isosceles triangular form with a 90° apex angle and the hinged lid is provided by a side wall at the base of the triangular end walls.

19. A container as claimed in claim 16 or claim 17, wherein the triangular end walls are isosceles triangles, and the fold lines in the triangular end walls extending from the apex thereof are perpendicular bisectors of the opposing bases of the end walls.

* * * * *